US006129614A

United States Patent [19]

Faas et al.

[11] Patent Number: 6,129,614

[45] **Date of Patent: *Oct. 10, 2000**

[54] APPARATUS FOR GRINDING CLOTHING OF A TEXTILE MACHINE

[75] Inventors: Jürg Faas, Andelfingen; Christian Sauter, Flurlingen; Beat Näf, Jona, all of Switzerland

[73] Assignee: Maschinenfabrik Rieter AG, Winterthur, Switzerland

[ * ] Notice: This patent issued on a continued prosecution application filed under 37 CFR 1.53(d), and is subject to the twenty year patent term provisions of 35 U.S.C. 154(a)(2).

[21] Appl. No.: 08/816,775

[22] Filed: Mar. 18, 1997

[30] Foreign Application Priority Data

Apr. 12, 1996 [CH] Switzerland ..... 0933/96

[51] Int. Cl.[7] ..... B24B 19/18

[52] U.S. Cl. ..... 451/184; 451/416

[58] Field of Search ..... 451/416, 417, 451/184

[56] References Cited

U.S. PATENT DOCUMENTS

| | | | |
|---|---|---|---|
| 429,044 | 5/1890 | Middleton et al. | 451/416 |
| 1,886,088 | 11/1932 | Dronsfield . | |
| 2,849,844 | 9/1958 | Snape, Jr. | 451/416 |
| 3,528,205 | 9/1970 | Roberts . | |
| 4,984,395 | 1/1991 | Demuth | 451/416 |

FOREIGN PATENT DOCUMENTS

| | | | |
|---|---|---|---|
| 0322637B1 | 7/1989 | European Pat. Off. . | |
| 0394831 | 10/1990 | European Pat. Off. . | |
| 0394831A3 | 10/1990 | European Pat. Off. . | |
| 0565486A1 | 10/1993 | European Pat. Off. . | |
| 0583219A1 | 2/1994 | European Pat. Off. . | |
| 0787841A1 | 8/1997 | European Pat. Off. . | |
| 45171 | 11/1888 | Germany . | |
| 61636 | 7/1891 | Germany . | |
| 606832 | 11/1934 | Germany . | |
| 9414196 | 6/1995 | Germany . | |
| 57112415 | 7/1982 | Japan . | |
| 3295169 | 12/1988 | Japan | 451/416 |
| 015145 | of 1893 | United Kingdom | 451/416 |
| 22533 | 12/1895 | United Kingdom . | |
| 490317 | 8/1938 | United Kingdom | 451/416 |
| 679033 | 9/1952 | United Kingdom | 451/416 |
| 2007280 | 5/1979 | United Kingdom . | |

OTHER PUBLICATIONS

Search Report Dated Aug. 18, 1997 For International Application No. 97810178.0.

*Primary Examiner*—Robert A. Rose
*Attorney, Agent, or Firm*—Dority & Manning

[57] ABSTRACT

A grinding apparatus for the flats of a card comprises elastically bendable elements which penetrate between the points of the flat clothing sweep along the lateral flanks of the flat clothing wires and grind the points in the process.

32 Claims, 5 Drawing Sheets

APPARATUS FOR GRINDING CLOTHING OF A TEXTILE MACHINE

The present invention concerns the grinding of clothing, in particular but not exclusively, of the clothing of flats of a revolving flat card in a textile machine. The invention is applicable to the mounting of a grinding apparatus onto the card, but is not restricted to this application and thus could be applied also to an apparatus to be placed onto a card and carried from card to card as required. The concept of the present invention is laid out in such a manner that the apparatus may function on a running card. This point also does not constitute any restriction in the sense that the invention could not be applied to a card at a standstill.

BACKGROUND OF THE INVENTION

Grinding of flat clothing is described in "Handbuch der textilen Fertigung, Die Kurzstapelspinnerei" (Handbook of Textile Manufacturing, Short Staple Spinning) Volume 2: Putzerei und Karderie (Opening and Cleaning) (The Textile Institute, Author: W. Klein), p.58/59. The means applied in this process are well known since a long time—compare e.g. GB 22533 issued 1895, DE 61636 issued 1891 and DE 606 832 issued 1933. A further proposal suggesting that the revolving flat arrangement can be taken off the machine as a "module" for maintenance purposes is shown in DE 2741089 by Trützschler. A more recent grinding apparatus was described also in JP 57-112415 (published Jul. 13, 1982).

In EP-C-322637 a grinding apparatus has been shown which constantly is in operation, or operable respectively. This apparatus can be applied to grinding the clothing of a flat, and a corresponding embodiment has been shown in FIG. 3 of the EP-C-322637 which in the following will be discussed with reference to FIG. 2 of the present application; a more detailed discussion being dispensed with here.

SUMMARY OF THE INVENTION

The present invention proposes a grinding apparatus characterized in that a plurality of grinding elements is provided, which elements can penetrate between the points of the clothing to be ground, and sweepingly brush the head portions of the points. The grinding elements preferably are elastically bendable.

The grinding elements can be arranged in such a manner that during operation they are distributed over the working width of the card. For this purpose, they can be supported on an elongated support member e.g. in such a manner that one end of each grinding element is mounted onto the support member from which it extends at right angles.

The arrangement can be laid out in such a manner that worn grinding elements (no longer in working order) can be replaced by exchanging the support member. For this purpose, the support member can be formed by two half shells e.g. according to the principle explained with reference to the FIGS. 4 and 5 of the DE utility model 94 14 196.

The grinding apparatus can comprise a support member which during operation can be mounted movably, e.g. rotatably. The support member can be mounted onto the card frame during operation using a holding device in a roughly predetermined relation to the revolving flat arrangement, e.g. in such a manner that the clothing of the flats can be ground while they pass through their "return cycle."

The grinding elements, the support member and the holding device together can form a unit built into the card e.g. in such a manner that operation of the apparatus is started together with the card start-up. In this arrangement the card can comprise a drive, and a control device respectively, for the grinding apparatus. The combined unit also could be designed in such a manner that it can be attached to the card, in which case the unit would contain its own drive, and control mechanism respectively.

Embodiments of the present invention are described in more detail in the following description with reference to various illustrated design examples.

DETAILED DESCRIPTION OF THE PREFERRED EMBODIMENTS

Figure 1:
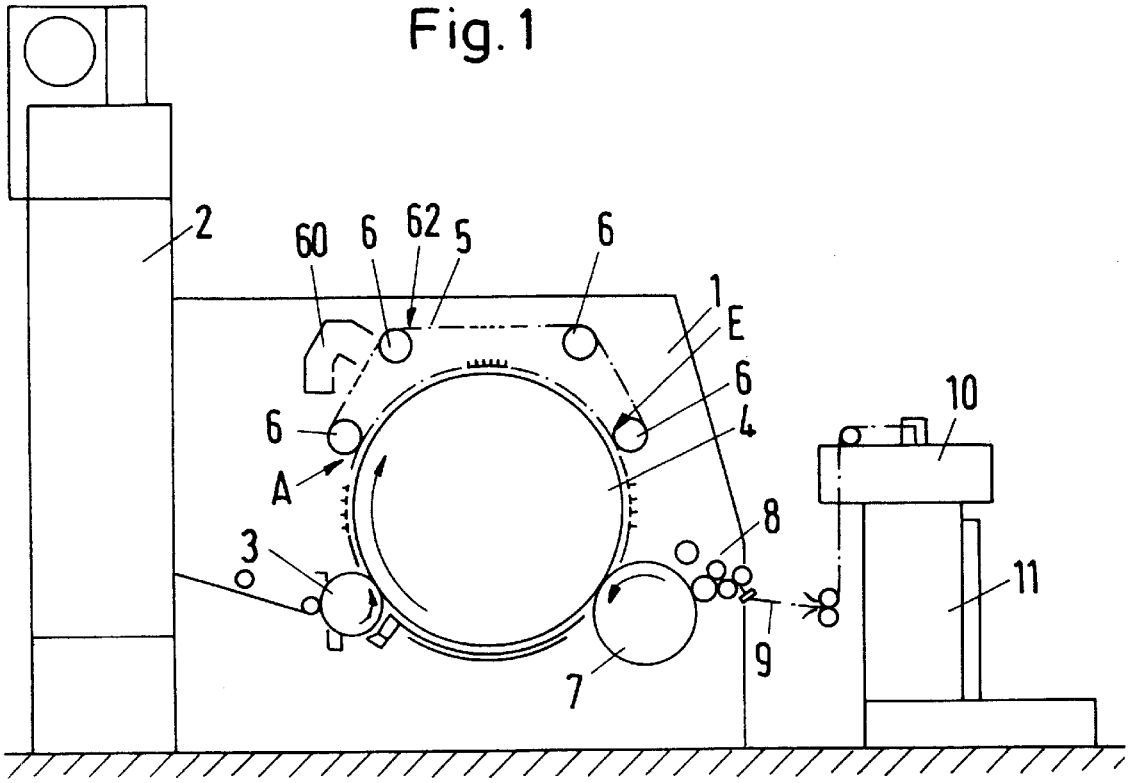
FIG. 1 is a copy of the FIG. 1 from the EP Application Nr. 96 101 466 dated Feb. 2, 1996.

Reference will now be made in detail to the presently preferred embodiments of the invention, one or more examples of which are illustrated in the drawings. Each example is provided by way of explanation of the invention, and not meant as a limitation of the invention. For example, features illustrated or described as part of one embodiment can be used on another embodiment to yield a still further embodiment. It is intended that the present application include such modifications and variations.

In FIG. 1 a revolving flat card 1 known as such, e.g. the C50 card produced by Maschinenfabrik Rieter AG, is shown schematically. The fibre material in the form of opened and cleaned fibre flocks is fed into the feed chute 2, and is taken over by a taker-in or licker-in roll 3 as a feed lap, is transferred to a main drum 4 and is opened further and cleaned by means of a set of revolving flats 5 driven forward or backward, as seen in the direction of the rotation of the drum 4, along a closed loop path over deflecting rolls 6. Fibres from the web located on the main drum 4 then are taken over by a doffer 7 and in a delivery roll arrangement 8 are formed into a card sliver 9. A coiler 10 then deposits the card sliver 9 into a can 11 in cycloid manner. The set of revolving flats 5 comprises revolving flats not shown individually in the FIG. 1 but indicated in the FIG. 2, and in the FIG. 3 respectively, with the reference sign 13. Each flat 13 is provided with clothing 14.

The individual flats 13 of the set of revolving flats 5 move "forward" from an entry point E through to an exit point A.

The carding work is effected during the forward movement. During the "return" movement the flats are cleaned while passing a cleaning point 60—the cleaning action being explained in more detail in the following with reference to the FIG. 3. Subsequently, the clothing 14 on the flats 13 could be ground according to EP C-322 637 as explained with reference to the FIG. 2.

Figure 2:
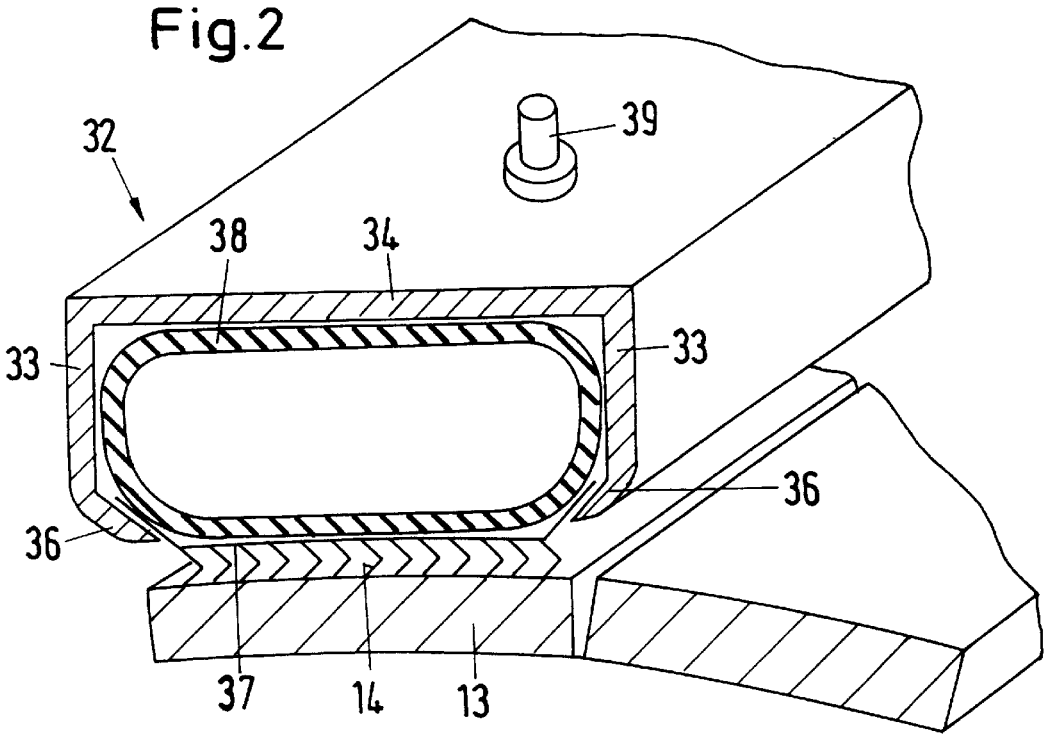
FIG. 2 is a copy of the FIG. 3 from EP-C-322 637.

In the FIG. 2, a grinding device 32 is shown acting onto the flats 13. The grinding device 32 comprises a trough type container provided with two side walls 33 and a cover plate 34. The free rims 36 of the walls 33 extend parallel to the grinding device extending along the respective flat 13, and at right angles, respectively, to the direction of movement of the clothing 14. On the free rims 36 a support member 37 in the form of a bendable strip extends in longitudinal direction (at right angles of the drawing plane) of the flat 13 over its full length. On its side facing the flat 13, the support member 37 is provided with a grinding coat consisting of e.g. fine grinding particles, in particular of diamond powder. The support member 37 can be e.g. a thin metallic strip, a fabric or a synthetic material strip provided with an abrasive coat, which strip adapts to local unevenness, i.e. to the geometrical shape of the surface defined by the tips of the clothing, without being deformed by the grinding forces. Furthermore, the strip is not to form any creases.

A hose 38, closed at both ends, made from an elastic material extends inside the trough-shaped container 33, 34 over its full width. Via a valve 39 the hose 38 can be filled with a fluid under a desired pressure. During operation, the hose 38 thus exerts the same pressure at any point along the support member 37. The support member 37 thus is pressed against the cover 13 and thus with its abrasive coat uniformly contacts the clothing 14. As a result, even in the presence of irregularities in the height of the points of the clothing 14, uniform contact of the support member 37 over the full width of the cover 13 is maintained. This is effected as areas of the support member 37 moving into any humps or recesses can perform their movement only if neighboring areas simultaneously perform movements comprising components in the direction parallel to the support member 37, i.e. a horizontal component as indicated in the FIG. 2.

The grinding device shown is only capable of acting upon the outer face areas of the wire points of the flat clothing. Even if conventional grinding devices function in similar manner, their performance proves detrimental for certain types of clothing. Furthermore, the relative movement between the grinding means and the clothing is too slow if the flat movement is relied upon.

Figure 3:
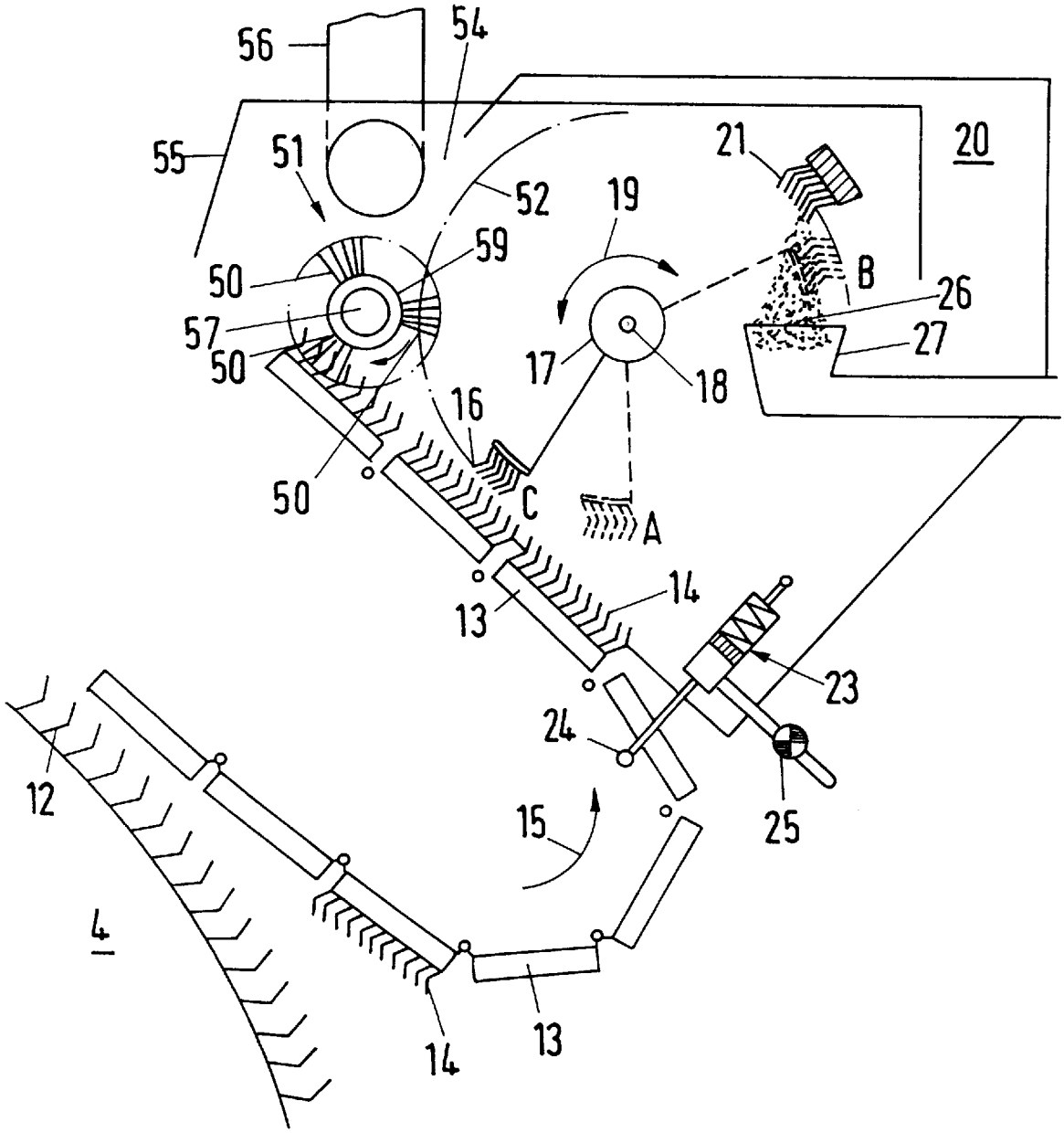
FIGS. 3 to 5 are copies of the FIGS. 3 through 5 from the DE Utility Model 94 14 196 mentioned above.

In the FIG. 3 a cleaning device is shown provided with a pivotable device 16 which is irrelevant within the scope of the present invention and thus is not described further here. Furthermore the cleaning device comprises a brush roll 51 rotatable with a predetermined rotational speed and provided with bristles 50 extending on one hand down to the base of the clothing 14 of the flat 13 and on the other hand extend into the pivoting reach 52 (indicated schematically with a dash-dotted circular line) of the pivotable device 16. The latter is provided with clothing wires as can be seen from the Figures.

As the bristles 50 extend into the pivoting reach 52, they are cleaned during the clockwise cleaning movement, as seen in the FIG. 3, of the device 16.

In this arrangement, the bristles are provided in rows, preferentially in a coiled arrangement. The brush 51 extends over the full working width. Soon after leaving the device 16, a flat 13 contacts the brush 51 which then effects a second cleaning action.

A hood 55 encloses a suction area 54. Into this area a suction duct 56 merges, which (e.g.) can be integrated into a system according to EP-A394 831 and EP-A-583 219 respectively. Dust and fly waste kicked up by the bristles 50 now are sucked into the suction area 54 and are eliminated via the suction duct 56. The suction of course also eliminates any material which falls off from the device 16.

In the FIGS. 4 and 5, a preferred design example of the brush 51 is shown which in the following is described in more detail, in which arrangement the brush roll 51 (FIG. 3) is rotated by a shaft 57 via a drive (not shown). The drive shaft 57 is supported in bearings (not shown) which are mounted into the side walls 20. The drive shaft 57 thus cannot be taken off from its support without an effort. The brush 51 is a wear part to be replaced from time to time.

Basically the brush 51 consists of a sleeve 59 (FIG. 3) and the bristles 50 mentioned before. These bristles are provided on the sleeve 59 and extend radially away therefrom. According to the FIG. 4 the sleeve 59 is made up by two "half shells" 59A, the end portions of one half shell being shown in a side view in the FIG. 5. Each half shell has a cylindrical outer sleeve surface 62 and an inner surface 63, which in its mounted state tightly hugs the shaft 57. The two half shells which together form the sleeve 59 are identical as to the structure of the part sleeve 59A as well as to the array of bores 60 (FIG. 5) taking up the bristles 50. It thus is not required that any specific "pair" of such half shells be chosen to make up a brush 51, as any two half shells match as well as any other half shells. The bristle arrangements on the two half shells of a brush 51 thus do not represent mutual mirror images but are arranged in such a manner that if the brush 51 is rotated over 180° about the longitudinal axis of the drive shaft 57, the bristles 50 of the one half shell 59A take up the positions previously held by the bristles 50 of the other half shell 59A.

The half shells 59A each are provided with fastening means in the form of through bores 61. Bolts (not shown) can be inserted there through connecting the two half shells to the drive shaft 57. The drive shaft for this purpose is provided with two rows of bores (not shown) the inside of each bore being threaded, the bores of these rows being coordinated with the bores 61. However, alternative (preferentially easy to release) fastening means may be provided instead.

More than two longitudinal elements of course can be provided to form the brush 51. The simple solution providing just two half shells presents considerable advantages in comparison to more complex design solutions.

Figure 4:
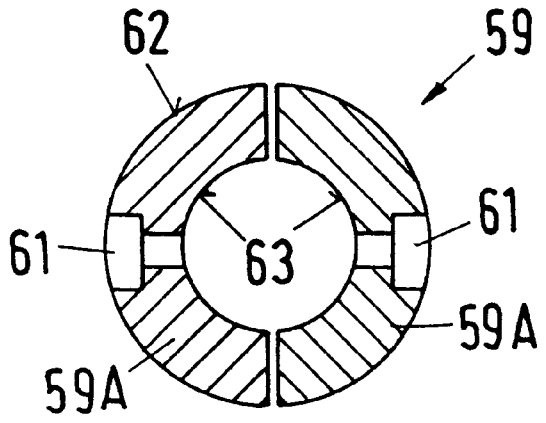
Figure 5:
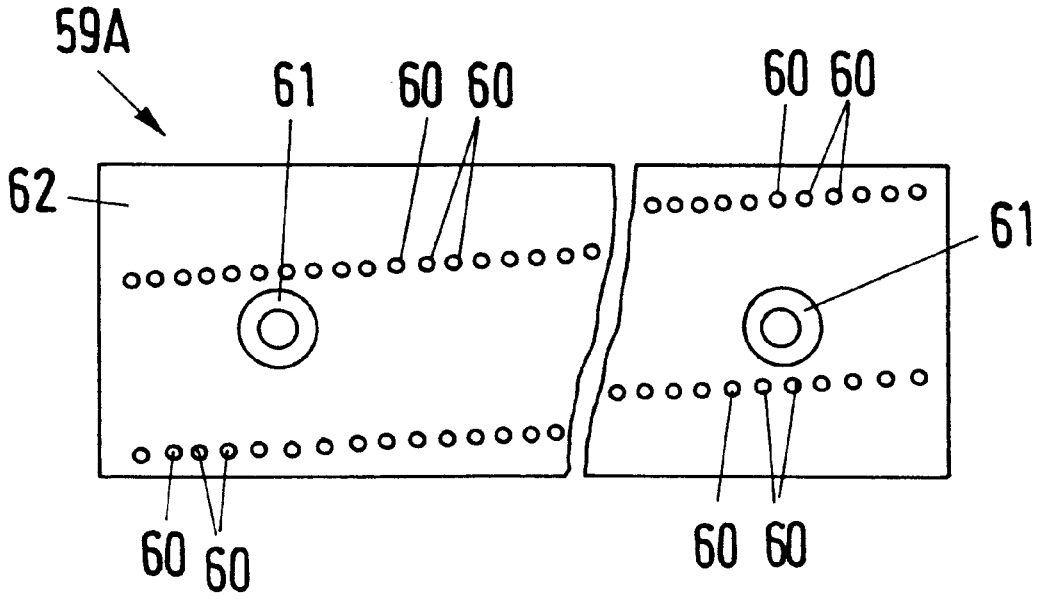
Figure 6:
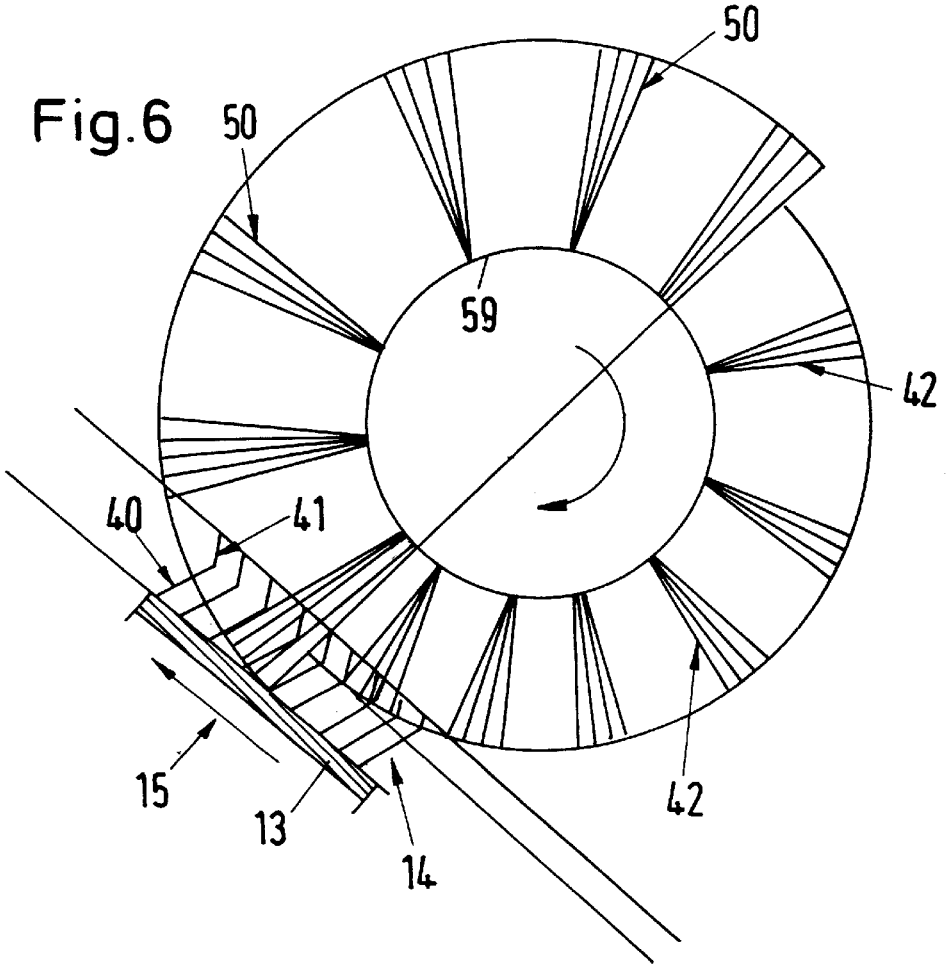
FIG. 6 is a first embodiment of the present invention in the form of a modification of the arrangement according to the FIGS. 3 to 5.

In the FIG. 6 a first design example according to the present invention is shown designed as a modification of the arrangement illustrated in the FIGS. 3 to 5. Accordingly, a flat bar 13 (including its clothing 14), the sleeve 59 and the bristles 50 (as far as still present) are shown schematically again in the FIG. 6. The direction of movement of the flat bar 13 and the sense of rotation of the sleeve 59 are indicated by arrows.

As usual in providing clothing on card flats, the clothing chosen is a flexible or a semi-rigid clothing (compare the above mentioned handbook of textile manufacturing, Volume 2, p.52) in which the individual clothing components 40 are each made from wire (of rectangular or round cross-section) forming a so-called knee 41. The bristles 50 penetrate down to the base of the clothing 14, i.e. down to the surface of the flat bar 13 from which the wires protrude, in such a manner that the clothing is cleaned thoroughly. In this arrangement, however, only half the circumference of the sleeve 59 is provided with bristles, the other half being provided with grinding elements 42 as will be discussed in more detail in the following with reference to the FIGS. 9 and 10. The sleeve 59 in this case serves as a support member for the grinding elements 42 which together with their support member and its holder arrangement form the grinding apparatus according to the present invention.

The grinding elements in this arrangement resemble the bristles 50 in so far as they are formed as elongated, elastically bendable elements protruding approximately radially from the sleeve surface of the sleeve 59. The grinding elements 42 also are more flexible than the wires 40, whereby during rotation of the sleeve and contact of one of these elements with a wire by movement of the element relative to the wire, the grinding element 42 has to yield. The elements 42 are substantially shorter than the bristles 50 in such a manner that they can reach the "head portions" only of the clothing wires 40 (above the respective knees 41)—compare also the FIGS. 7 and 8. The speed of the free end portion of each element 42 still exceeds the speed of the clothing wires 40 in the direction of the flat movement 15. As the grinding elements sweep along the clothing elements 40, they penetrate into the clothing and their free end portions are deflected to both sides of the head portions of the wires 40 (FIG. 7).

The head portion of each wire element is ground on its flanks in such a manner that its lateral flanks 43 (FIGS. 7 and 8) converge radially outwards forming an end edge 44. During each passage of the grinding elements 42 brushing the flank surfaces 43, these surfaces 43 are subject to a polishing or grinding action. The aggressiveness of the polishing or grinding action depends on the design of the grinding elements and on their relative speed of movement. The optimum effectiveness can be determined experimentally for each type of clothing wire.

Figure 7:
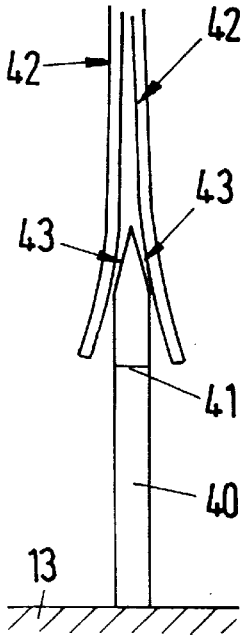
FIG. 7 is a schematic view of an individual clothing wire element seen from the front side visualizing the grinding action.
Figure 8:
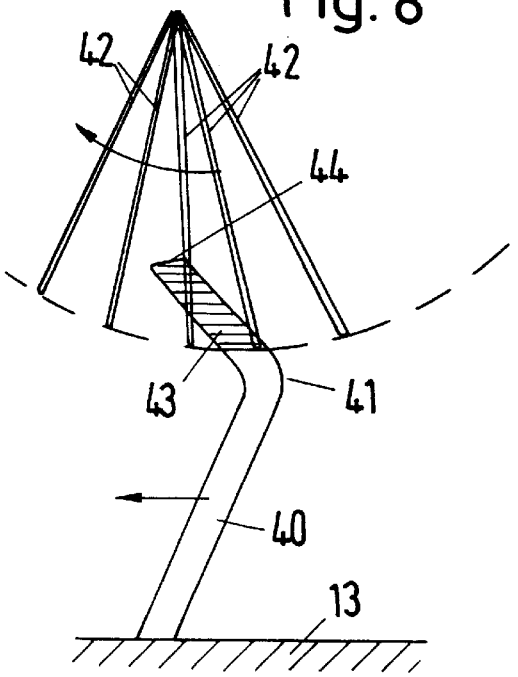
FIG. 8 is a schematic side view of the same individual clothing wire element.

The solution described with reference to the FIGS. 6 to 8 presents certain advantages for retrofitting on existing cards. The "infrastructure" (i.e. the support member in the form of a sleeve 59, its holding device in the form of the drive shaft 57, its bearing arrangement and its corresponding drive arrangement (not shown here) are present already on the existing card. Furthermore, the apparatus according to the design example described can be installed easily as just one of the "half shells" according to the FIGS. 4 and 5 is to be provided with grinding elements 42 instead of the bristles 50. The flat cleaning device is working continually (as long as the card is in operation), and the clothing wires on the flats thus are ground "continually". But on the other hand certain disadvantages of this solution are to be incurred, however:

- cleaning efficiency decreases, as half the bristles 50 are "missing",
- obtaining optimum cleaning effectiveness as well as optimum grinding action may not be possible by adapting the rotational speed of the drive shaft 57 (FIG. 3),
- it is not possible to "stop" just the grinding action e.g. in order to perform periodic grinding (according to a "stop and go" method. A grinding method of this type has been described e.g, in EP-A-565 486.

In certain cases it thus will prove advantageous if a separate infrastructure is provided on the card, in particular a separate holding device for the support member (on which the grinding elements 42 are mounted) and a separate (and, if required, controllable) drive arrangement. In an arrangement of this type, a desired speed of the grinding elements relative to the clothing wires exceeding 15 m/s (e.g. of 20 m/s) can be reached, which speed would not be of optimum suitability for cleaning bristles. The grinding point in this arrangement is separated from the cleaning point and preferentially is situated downstream, as seen in the direction 15 of flat movement (FIG. 6), from the cleaning point. If a control programme is desired for controlling the flat clothing grinding process, a programme of such type can be integrated in the card control system. If the grinding apparatus is laid out independently of the cleaning device, no sleeve 59 is required as support member and the grinding device does not necessarily have to be arranged rotatably. The relative movement between the grinding elements and the clothing wires can hardly be effected by the movement of the clothing wires in the direction 15 (FIG. 6) alone, i.e. a stationary support of the grinding elements normally will not be sufficient.

In a further alternative solution, the grinding elements could be moved linearly along the path of the movement of the flat bars 13, an arrangement which could cause problems as it generally is considered undesirable that the grinding elements first impact the free end of a clothing wire. After a grinding movement in a direction in which the grinding elements approaches, and sweeps over, the free end of the clothing wire "from behind", the grinding elements eventually are to be "pulled out" before they are moved back to the starting point of the subsequent grinding movement, which arrangement is complicated and thus cost-intensive. A lifting movement also requires relatively ample space within the revolving flat arrangement. For these reasons, the support member of the grinding elements preferentially are arranged rotatably in the card, regardless of whether the support member consists of half shells 59A or of a cylindrical sleeve. For simplicity, only the last mentioned possibility is shown in the FIGS. 9 and 10.

Figure 9:
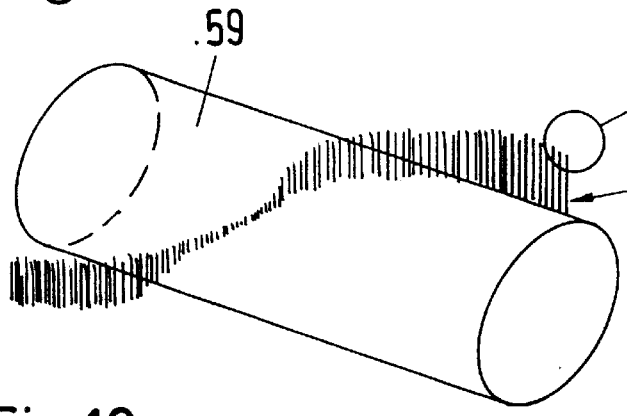
FIG. 9 is a schematic isometric view of a second embodiment, a detail indicated in the FIG. 9 being shown in the FIG. 9A.
Figure 9A:
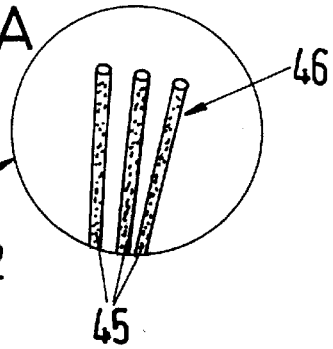

The alternative solution according to the FIG. 9 comprises a coil type array of grinding elements 42 along a cylindrical support member. Each element is shaped as a bristle 45 (compare particularly the detail shown in the FIG. 9A). The bristles 45 are shorter than the bristles 50 in the arrangement described with reference to the FIG. 6 and the free end of each bristle 45 is coated with an abrasive forming a grinding area (grinding element). The coating consists for example of hard particles 46 (grinding particles, diamond particles or similar) secured to the bristle 45 by adhesive. The coil-shaped row of elements 42 extends over the full length of the support member and thus over the full working width. On the side of the sleeve 59 which is not visible in the FIG. 9 a second row of grinding elements can be arranged forming a mirror image of the first row.

Figure 10:
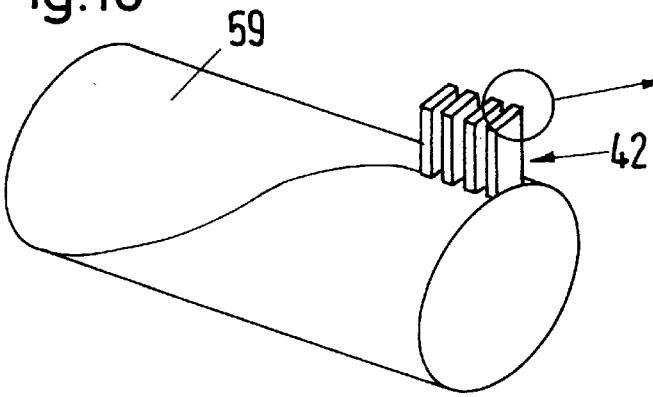
FIG. 10 is a schematic isometric view of a third embodiment, a detail indicated in the FIG. 10 being shown in the FIG. 10A, and FIGS. 11 to 13 are further alternative embodiments according to the invention.
Figure 10A:
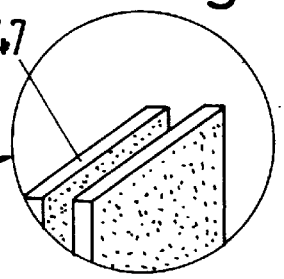

The alternative design example according to the FIG. 10 also comprises a coil-shaped array of grinding elements 42, which in this case are provided in the form of grinding lamellae 47 (compare particularly the detail shown in the FIG. 10A) which also are coated with an abrasive in the form of hard (grinding) particles. The lamellae 47 can be made e.g. from "emery cloth".

Figure 11:
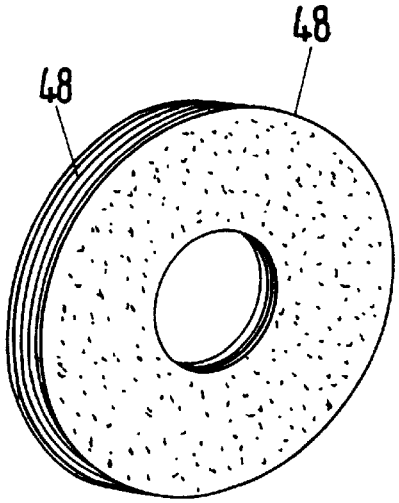

The design example shown partially only in the FIG. 11 corresponds to the alternative design examples according to the FIGS. 9 and 10 in so far as they are made up by coating a base body. In the FIG. 11, the base body is formed by a disc 48 both sides of which are coated with hard particles, in which arrangements the disk forms a "grinding wheel". The discs can be of annular shape and of a thickness that can vary in radial direction in such manner that they are thinner at the outer edge and thicker at the inner edge. The inner portion of each disc can be fastened to a support member (not shown) which is rotatably mounted on the machine. The disks 48 are fastened in such a manner that they rotate together with their support member. Their (relatively thin) outer edge portions form elastically bendable grinding areas the function of which resembles the one of the free ends of the elements 42 according to the solution described with reference to the FIG. 7, i.e. they yield under contact with the head portion of a clothing wire but they grind the flanks 43 as they sweepingly brush along them.

Figure 12:
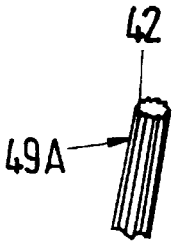
Figure 13:
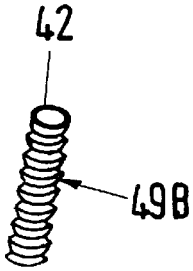

The solutions according to the FIGS. 12 and 13 are designed differently as they are not provided with a coating, but rely on the abrasive action of the base body itself. For this purpose, the surface of each of the elastically bendable bodies (or of each "flexible finger" respectively) is "profiled", in one case (FIG. 12) by forming longitudinal ribs 49A and by forming transverse ribs 49B. The material of which the elements, or the fingers respectively, are made, should be hard in comparison to the metal of the clothing wires to be ground, e.g. steel bristles.

The description thus far has been based on the assumption that the grinding apparatus should be built into the card. The present invention, however, is not restricted in any way to an arrangement of the type mentioned. The card could be provided e.g. with mounting points merely to which a support arrangement of the grinding apparatus could be attached. The grinding apparatus itself could be moved from card to card and be mounted and operated on a particular card only if required. An apparatus of this type could be equipped with its own separate drive arrangement for rotating the support member to which the grinding elements are fastened, or could be provided with a clutch arrangement merely for temporarily establishing a connection with the drive arrangement of the machine.

The preferred solution comprises a grinding apparatus provided with its own "infrastructure" (support member, drive arrangement, etc.,) and with grinding elements according to the FIG. 9 in which arrangement the support member 59 preferentially is "fully clothed" (instead of being provided with individual coil-shaped remains of grinding element arrangements) i.e. provided with grinding elements covering substantially the whole circumference.

It will be apparent to those skilled in the art that various modifications and variations can be made in the present invention without departing from the scope and spirit of the invention. It is intended that the present invention cover such modifications and variations as come within the scope of the appended claims and their equivalents.

We claim:

1. A carding machine for processing fiber material, said carding machine comprising:

a machine frame and a main drum disposed within said frame to receive fiber material;

a set of moving flats disposed relative to said main drum to clean and open fiber material carried by said main drum, said flats comprising individual clothing elements protruding from a base member;

a grinding apparatus disposed relative to said set of moving flats, said grinding apparatus comprising a plurality of grinding elements extending from a support member that is driven in the same direction as said set of moving flats, said grinding elements having a length so as to penetrate between said clothing elements and sweep over free ends of said clothing elements from behind as said grinding elements move relative to said set of flats thereby grinding said individual grinding elements.

2. The carding machine as in claim 1, wherein said grinding elements are formed from an elastic bendable material.

3. The carding machine as in claim 1, wherein said set of flats comprises a working width, said grinding elements distributed over said working width to grind said individual clothing elements over said working width.

4. The carding machine as in claim 3, wherein said support member comprises an elongated member extending generally across said working width.

5. The carding machine as in claim 3, wherein said support member comprises half shell members.

6. The carding machine as in claim 1, wherein said support member and attached grinding elements is replaceable in said machine frame.

7. The carding machine as in claim 1, wherein said support member is rotatably driven.

8. The carding machine as in claim 1, wherein said set of moving flats are driven in a revolving path including a return path, said grinding apparatus disposed to grind said clothing elements as said set of moving flats moves through said return path.

9. The carding machine as in claim 1, wherein said grinding apparatus is portable and removably connected to said machine frame.

10. The carding machine as in claim 1, further comprising a control system configured for controlling operation of said carding machine, said grinding apparatus integrated with and controlled by said control system.

11. The carding machine as in claim 10, wherein said control system comprises a drive system, said grinding apparatus driven by said drive system.

12. The carding machine as in claim 1, wherein said grinding apparatus is removably connected to said machine frame and further comprises a drive system removable therewith wherein said grinding apparatus is drivable independent from a drive system of said carding machine.

13. The carding machine as in claim 1, wherein said grinding elements move in a direction relative to said clothing elements so that said grinding elements extend between and contact said clothing elements before said free ends of said clothing elements are sweep over by said grinding elements.

14. The carding machine as in claim 13, wherein said clothing elements extend at a tangential angle relative to said base member.

15. The carding machine as in claim 1, further comprising a cleaning system disposed to clean said set of moving flats, said grinding apparatus integrated with said cleaning system.

16. A grinding apparatus for use on a carding machine having a machine frame and set of moving flats mounted thereon wherein said flats include individual clothing elements protruding from a base member, said grinding apparatus comprising:

a support member, and means for mounting said support member on said machine frame;

means for driving said support element in the same direction as said set of flats; and a plurality individual grinding elements mounted on and extending from said support member and having a length so as to extend between said individual clothing elements, said grinding elements bendable relative to said clothing elements so that said grinding elements extend between and sweep over said individual clothing elements from behind as said grinding elements move relative to said flats.

17. The grinding apparatus as in claim 16, wherein said grinding elements are formed of an elastic material.

18. The grinding apparatus as in claim 16, wherein said support member comprises an elongated member having a length so as to extend across a working width of said flats.

19. The grinding apparatus as in claim 18, wherein said support member comprises half shell members.

20. The grinding apparatus as in claim 18, wherein said support member is removably mountable to said machine frame.

21. The grinding apparatus as in claim 16, wherein said support element with attached grinding elements is a replaceable component.

22. The grinding apparatus as in claim 16, wherein said support element is rotatably driven.

23. The grinding apparatus as in claim 16, wherein said means for driving said support element comprises a drive system of said carding machine, said support element operably connectable to said carding machine drive system.

24. The grinding apparatus as in claim, 16, wherein said grinding apparatus is portable and is removably attachable to different carding machines.

25. The grinding apparatus as in claim 24, wherein said means for driving said support element comprises a portable drive system that operates independent of a drive system of said carding machine.

26. A carding machine for processing fiber material, said carding machine comprising:

a machine frame and a main drum disposed within said frame to receive fiber material;

a set of moving flats disposed relative to said main drum to clean and open fiber material carried by said main drum, said flats movable in a forward direction relative to said main drun and a return direction, said flats comprising individual clothing elements protruding from a base member;

a grinding apparatus disposed along a return direction of said flats, said grinding apparatus comprising a plurality of grinding elements from a rotatable support member, said grinding elements having a length so as to penetrate between and sweep over free ends of said clothing elements; and wherein said support member is rotatably driven relative to an orientation of said slothing elements such that said grinding elements approach said clothing elements from behind and seep over back sides of said free ends as said flats move along said return direction of movement.

27. The carding machine as in claim 26, wherein said grinding elements are formed from an elastic bendable material.

28. The carding machine as in claim 26, wherein said set of flats comprises a working width, said support member extending across said working width and said grinding elements distributed over said working width to grind said individual clothing elements over said working width.

29. The carding machine as in claim 26, wherein said grinding apparatus is portable and removably connected to said machine frame.

30. The carding machine as in claim 26, wherein said grinding apparatus is removably connected to said machine frame and further comprises a drive system removable therewith wherein said grinding apparatus is drivable independent from a drive system of siad carding machine.

31. The carding machine as in claim 26, wherein said clothing elements extend at a tangential angle relative to said base member.

32. The carding machine as in claim 26, further comprising a cleaning system disposed to clean said set moving flats, said grinding apparatus integrated with said cleaning system.

* * * * *